US012331753B2

(12) United States Patent
Thomsen et al.

(10) Patent No.: US 12,331,753 B2
(45) Date of Patent: Jun. 17, 2025

(54) BLADE CONSTRUCTION

(71) Applicant: Nordicco A/S, Fredericia (DK)

(72) Inventors: Dennis Thomsen, Fredericia (DK); Jesper Hermansen, Skanderborg (DK)

(73) Assignee: NORDICCO A/S, Fredericia (DK)

( * ) Notice: Subject to any disclaimer, the term of this patent is extended or adjusted under 35 U.S.C. 154(b) by 0 days.

(21) Appl. No.: 18/575,211

(22) PCT Filed: Jun. 16, 2022

(86) PCT No.: PCT/DK2022/050130

§ 371 (c)(1),
(2) Date: Dec. 28, 2023

(87) PCT Pub. No.: WO2023/274473

PCT Pub. Date: Jan. 5, 2023

(65) Prior Publication Data

US 2024/0328430 A1 Oct. 3, 2024

(30) Foreign Application Priority Data

Jun. 28, 2021 (DK) ..... 2021 70334

(51) Int. Cl.
*F04D 29/38* (2006.01)
*F04D 19/00* (2006.01)
(Continued)

(52) U.S. Cl.
CPC ..... *F04D 29/388* (2013.01); *F04D 19/002* (2013.01); *F04D 25/0693* (2013.01); *F04D 29/005* (2013.01); *F04D 25/088* (2013.01)

(58) Field of Classification Search
CPC ..... F04D 29/388; F04D 19/002; F04D 25/088
See application file for complete search history.

(56) References Cited

U.S. PATENT DOCUMENTS 4,422,824 A * 12/1983 Eisenhardt, Jr. ..... F04D 25/088 55/467
7,252,478 B2 8/2007 Aynsley
(Continued)

FOREIGN PATENT DOCUMENTS

CN 202001939 U 10/2011
CN 105526564 A 4/2016
(Continued)

OTHER PUBLICATIONS

Dannish Search Report for DK Application No. PA 2020 70721 mailed Mar. 13, 2021 (4 pages).
(Continued)

*Primary Examiner* — Sabbir Hasan
(74) *Attorney, Agent, or Firm* — Merchant & Gould P.C.

(57) ABSTRACT

The present invention disclose a blade construction for a blade for a fan and the use of such a blade in a fan, wherein said blade construction incorporates a light source emitting light away from said blade, and where said blade has a longitudinal extend in use radially to an axis of rotation for said fan, such that the blade construction has a root end suitable to be attached to a rotor unit, and a distal end furthest away from said root end, where the blade has an aerodynamic cross-section in a cross-section orthogonal to the longitudinal direction.

10 Claims, 4 Drawing Sheets

(51) Int. Cl.

| | |
|---|---|
| ***F04D 25/06*** | (2006.01) |
| ***F04D 29/00*** | (2006.01) |
| *F04D 25/08* | (2006.01) |

(56) References Cited

U.S. PATENT DOCUMENTS

| | | | |
|---|---|---|---|
| 7,284,960 | B2 | 10/2007 | Aynsley |
| D607,988 | S | 1/2010 | Oleson et al. |
| 7,654,798 | B2 | 2/2010 | Aynsley |
| D612,476 | S | 3/2010 | Noble |
| D614,757 | S | 4/2010 | Noble |
| 7,934,907 | B2 | 5/2011 | Aynsley et al. |
| 8,162,613 | B2 | 4/2012 | Oleson et al. |
| D690,409 | S | 9/2013 | Noble et al. |
| D692,120 | S | 10/2013 | Noble et al. |
| 8,770,949 | B2 | 7/2014 | Noble |
| 8,821,126 | B2 | 9/2014 | Oleson et al. |
| D717,935 | S | 11/2014 | Strecker et al. |
| D717,936 | S | 11/2014 | Peterson |
| D723,678 | S | 3/2015 | Strecker et al. |
| D732,657 | S | 6/2015 | Peterson et al. |
| D770,027 | S | 10/2016 | Noble et al. |
| 9,458,859 | B2 | 10/2016 | Fizer |
| D781,252 | S | 3/2017 | Oleson et al. |
| 9,587,518 | B2 | 3/2017 | Oleson |
| D783,883 | S | 4/2017 | Cortez |
| 9,664,194 | B2 | 5/2017 | Oleson |
| D797,917 | S | 9/2017 | Oleson et al. |
| D808,004 | S | 1/2018 | Noble et al. |
| D810,702 | S | 2/2018 | Oleson et al. |
| 9,900,955 | B1 | 2/2018 | Kendle |
| D812,006 | S | 3/2018 | Noble et al. |
| 10,154,565 | B1 | 12/2018 | Wigler et al. |
| D879,282 | S | 3/2020 | Noble et al. |
| 11,268,528 | B2 | 3/2022 | Oleson et al. |
| 2002/0102161 | A1 | 8/2002 | Nordhoff |
| 2003/0230477 | A1 | 12/2003 | Fink et al. |
| 2006/0130663 | A1 | 6/2006 | Joshi et al. |
| 2009/0129974 | A1 | 5/2009 | McEllen |
| 2010/0104461 | A1 | 4/2010 | Smith et al. |
| 2011/0085908 | A1 | 4/2011 | Pelshak et al. |
| 2013/0272879 | A1 | 10/2013 | Chen |
| 2015/0009666 | A1 | 1/2015 | Keng et al. |
| 2016/0290357 | A1 | 10/2016 | Whitley et al. |
| 2017/0089346 | A1 | 3/2017 | Oleson et al. |
| 2019/0072107 | A1* | 3/2019 | Horng ..... F04D 29/34 |
| 2019/0072288 | A1 | 3/2019 | Niemiec et al. |
| 2019/0162433 | A1 | 5/2019 | Desmet et al. |
| 2019/0298869 | A1 | 10/2019 | Poulsen |
| 2020/0224897 | A1 | 7/2020 | Jackson et al. |
| 2020/0263700 | A1 | 8/2020 | Lee |
| 2021/0353820 | A1 | 11/2021 | Lesser |
| 2021/0388841 | A1 | 12/2021 | Rhoades et al. |
| 2021/0388842 | A1 | 12/2021 | Rhoades et al. |
| 2021/0388843 | A1 | 12/2021 | Rhoades et al. |
| 2021/0388844 | A1 | 12/2021 | Rhoades et al. |
| 2022/0133941 | A1 | 5/2022 | Thomsen et al. |

FOREIGN PATENT DOCUMENTS

| | | | |
|---|---|---|---|
| CN | 106247443 | A | 12/2016 |
| CN | 207333242 | U | 5/2018 |
| CN | 108278215 | A | 7/2018 |
| CN | 108457879 | A | 8/2018 |
| CN | 109209949 | A | 1/2019 |
| CN | 110685935 | A | 1/2020 |
| CN | 111617271 | A | 9/2020 |
| CN | 211778100 | U | 10/2020 |
| EP | 1870114 | A1 | 12/2007 |
| EP | 3936159 | A1 | 1/2022 |
| JP | H09-314137 | A | 12/1997 |
| KR | 1020100053366 | A | 5/2010 |
| KR | 1020130012612 | A | 2/2013 |
| WO | 2016/200047 | A1 | 12/2016 |
| WO | 2021/257658 | A1 | 12/2021 |

OTHER PUBLICATIONS

Danish Search Report for DK Application No. PA 2021 70311 mailed Nov. 22, 2021 (4 pages).

Danish Search Report for DK Application No. PA 2021 70334 mailed Dec. 1, 2021 (4 pages).

International Search Report and Written Opinion for PCT/DK2021/050319 mailed Feb. 2, 2022.

International Search Report and Written Opinion for PCT/DK2022/050127 mailed Sep. 21, 2022.

International Search Report and Written Opinion for PCT/DK2022/050130 (Sep. 13. 2022).

Office Action issued in Danish Patent Application No. PA 2021 70334 (Dec. 27, 2021).

* cited by examiner

BLADE CONSTRUCTION

This application is a National Stage Application of PCT/DK2022/050130, filed on Jun. 16, 2022, which claims the benefit of and priority to Patent Application No. PA 2021 70334, filed on Jun. 28, 2021 in Denmark, the entire disclosures of which are incorporated by reference herein in their entirety. To the extent appropriate, a claim of priority is made to each of the above-disclosed applications.

FIELD OF THE INVENTION

The present invention is directed to a blade construction for a blade for a fan as well as use of such a blade in a high-volume low speed fan.

BACKGROUND OF THE INVENTION

Fans are typically constructed by having a multiunit which has a rotating axle and at the end of the axle a plurality of blades mounted such that when the fan is in its mounted position, the blades will circulate in a substantially horizontal plane. It is therefore important that the blades are angled relatively to the direction through which they are brought to the air in order to agitate the air and preferably move air downwards towards the working zone, or in reverse pull air up from the working zone. Often blades for these types of fans are made from a bent piece of metal plane such that at least part of the plane of the blade will cause the air to move downwards. However, in a number of circumstances it may be necessary to provide structural capabilities to the blade, particularly where the length of the blade reaches a certain extent such that undesirable bending of the blade is avoided. For these reasons it is known to extrude the blades in aluminium where the blade profile comprises a number of reinforcement ribs. In this manner a relatively light and yet very strong and stiff blade element may be obtained.

However, when the blade is to be used for more intelligent purposes, for example when having built-in devices, it is often difficult to accommodate such devices in blade constructions simply designed for strength purposes. On the other hand, the blade profile may not be too cumbersome or clumsy in that that will have a detrimental effect on the ability to agitate air, the weight of the blade and also the noise generated from the blade passing through the air.

OBJECT OF THE INVENTION

Consequently, it is the object of the present invention to provide a blade construction which accommodates various appliances and at the same time maintain that air dynamically optimizes the profile together with housing the appliances and at the same time also providing the structural integrity for a stiff blade.

DESCRIPTION OF THE INVENTION

The invention addresses this by providing a blade construction for a blade for a fan, wherein said blade construction incorporates a light source emitting light away from said blade, and where said blade has a longitudinal extent in use radially to an axis of rotation for said fan, such that the blade construction has a root end suitable to be attached to a rotor unit, and a distal end furthest away from said root end, where the blade has an aerodynamic cross-section in a cross-section orthogonal to the longitudinal direction and where said cross-section consists of:

a. A first longitudinal chamber suitable to accommodate an electrical wire;
b. A second longitudinal chamber, which second longitudinal chamber is suitable to accommodate:
   i. near the root end, a transformer unit
   ii. near the distal end, said light source
c. A third longitudinal chamber suitable to accommodate:
   i. near the root end a mounting bracket, allowing the blade to be mounted to the ventilator's rotor unit;
   ii. near the distal end an endcap, said endcap having a cross-section corresponding to the cross-section of the blade, and where the endcap has a closed side and an opposing side having means for being attached to the blade, said means projecting into said third longitudinal chamber;
d. A fourth longitudinal chamber allowing the blade to obtain the aerodynamic shape.

Alternatively, a blade construction for a blade for a fan, wherein said blade construction incorporates a light source configured to emitting light away from said blade, and where said blade has a longitudinal extent in use radially to an axis of rotation for said fan, such that the blade construction has a root end suitable to be attached to a motor or rotor unit, and a distal end furthest away from said root end, where the blade has an aerodynamic profile in a cross-section orthogonal to the longitudinal direction and where said blade consists of:

a. a first longitudinal chamber suitable to accommodate an electrical wire;
b. a second longitudinal chamber suitable to accommodate:
   i. near the root end, a transformer unit;
   ii. near the distal end, said light source;
c. a third longitudinal chamber suitable to accommodate:
   i. near the root end, a mounting bracket, allowing the blade to be mounted to the motor or rotor unit;
   ii. near the distal end, an endcap having a cross-section corresponding to the cross-section of the blade, and where the endcap has a closed side and an opposing side having means for being attached to the blade, said means projecting into said third longitudinal chamber;
d. A fourth longitudinal chamber allowing the blade to obtain the aerodynamic profile.

The first, second and third longitudinal chambers are utility chambers where the intelligent equipment needed for providing extra features to the fan are accommodated. Particularly whereas is in this case the extra feature is a light source it is important not only to construct the blade such that the necessary appliances may be accommodated but also to make a design where it is easy to assemble the blades and at the same time easy to service should any of the technical facilities installed in the blade fail or need replacement for other reasons. By at the same time arranging the various technical features of the blade in a separate longitudinal chamber it is also ensured that the strength characteristics of the blade is maintained in that the separation between each chamber may be used as a reinforcing member of the overall blade construction.

In a further advantageous embodiment of the invention the second longitudinal chamber near the distal end of the blade forms an open top cavity, allowing the light source to emit light out of the cavity, and where light source holding means are provided furthest away from said distal end in the cavity for fixing the light source in the cavity, and where electrical socket connection means are provided near the distal end for providing electrical current to the light source, where said electrical socket connection means may be fixable in said end cap.

Particularly the manner in which the light sources are mounted in the blade construction and particularly where the socket for the light source is arranged in the end cap make it easy to maintain, replace or inspect the light sources such that the electrical connection is readily available.

In a further embodiment of the invention, an alternative to this is provided where the second longitudinal chamber near the distal end of the blade forms an open top cavity, allowing the light source to emit light out of the cavity, and where a light source holding tray is provided, said tray fitting inside the open top cavity, where said tray comprises means for fixing and holding a light source and for providing electrical current to said light source.

This embodiment of the invention provides further advantages in that by changing the inner properties of the tray and not the outer properties it is possible to still fit a standard tray inside the second longitudinal chamber, but by changing the design of the interior part of the tray, different light sources may be accommodated in a standard manner in a blade construction according to the present invention. This provides great versatility with respect to the choice of light sources and at the same time the manner in which this is incorporated in the blade construction is more or less standard in that only the tray needs to be replaced and by the provision of the end cap and a tray arranged near the distal end of the blade construction the entire light source is easily maintainable, re-placeable and easy to access.

In a still further advantageous embodiment of the invention, the outer dimensions of the tray are designed to be insertable into the open top cavity, and where the means for fixing and holding a light source and for providing electrical current to said light source is different for different trays, such that different sizes or types of light sources may be installed in different trays.

The cross section of the first, second and third longitudinal chambers is more or less determined by the electrical equipment which needs to be installed in these longitudinal chambers as explained above, where the fourth longitudinal chamber allows the de-signer to create the best possible air dynamic cross section in that the fourth chamber is not designed to accommodate any fixtures but the design of the chamber may be freely chosen in order to address any aerodynamic issues.

In this manner a blade construction addressing the containment, serviceability and ease of assembly of complicated technical installations is achieved which at the same time provides a strong, light and aerodynamically optimal blade for a fan.

The invention is also directed to use of such a blade construction in a fan, particularly a fan of the high volume low speed type where typically very large blades are used such that relatively large volumes of air is agitated and moved but where the blades are rotated at a slow speed. Particularly the slow speed generates less noise and together with a clever design of the blades, it is possible to design a fan with rather complicated blade constructions as described above but which is extremely silent.

DESCRIPTION OF THE DRAWING

The invention will now be explained with reference to the accompanying drawing wherein.

DETAILED DESCRIPTION OF THE INVENTION

Figure 1:
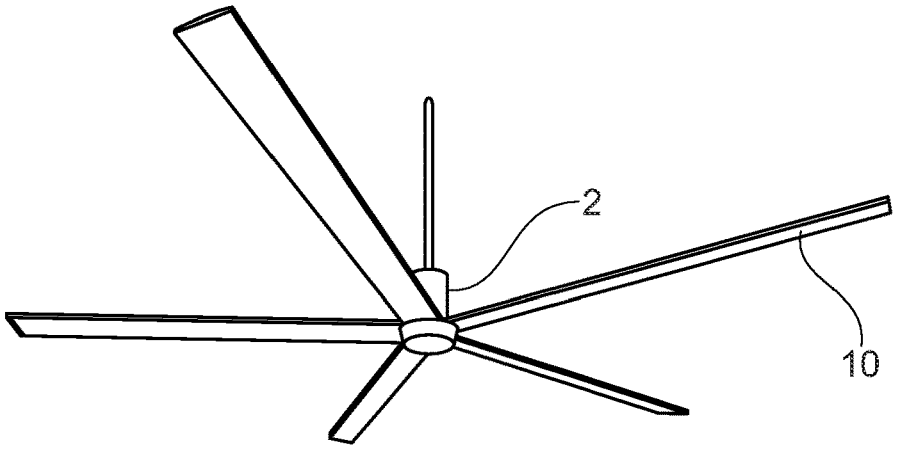
FIG. 1 illustrates an example of a ceiling mounted type fan.

In FIG. 1 is illustrated an example of a ceiling mounted type fan. The particular fan is a high volume low speed type fan. Five blades 10 are arranged attached to a motor 2 which causes the blades to rotate, thereby agitating the air. In the illustrated example the fan is special in that a light-source is incorporated in the blades, where the light is emitted upwards.

Figure 2:
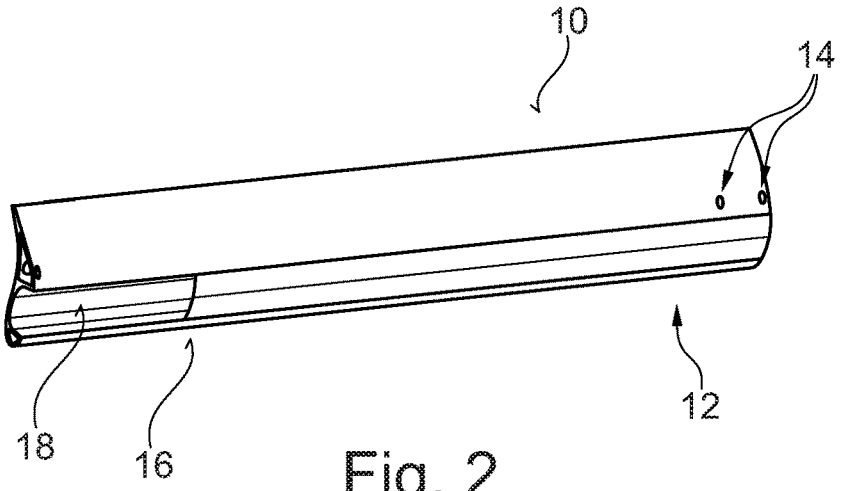
FIG. 2 illustrates an example of a blade 10 according to the present invention.

In FIG. 2 is illustrated an example of a blade 10 according to the present invention. In a first end (root end) 12 of the blade 10 are provided two apertures 14. These apertures 14 are used for mounting the blade 10 to the motor 2 (rotor unit).

In the other end (distal end) 16 of the blade 10 is provided a cavity 18. The cavity 18 is designed to house and hold a light source or a tray holding a light source (not illustrated)—as will be discussed below.

The length of the blade 10 may of course be designed according to the actual situation. Below the details of the blade will be discussed. From this description it is clear that the profile may be extruded. Consequently, when deciding on the length of the blade, it may be cut from the extruded length at any desired length. However, the internal strength must be calculated according to the ribs/walls internally in the blade's profile.

Figure 3:
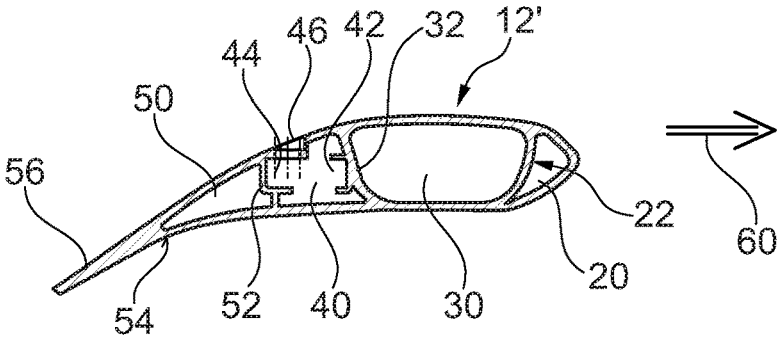
FIG. 3 illustrates a cross-section through the blade 10 near the first end (root end)

In FIG. 3 is illustrated a cross-section through the blade 10 near the first end (root end) 12. The blade's cross-section 12' in FIG. 3 comprises a cross-section of a first longitudinal chamber 20. The blade's cross-section 12' in FIG. 3 comprises a second longitudinal chamber 30, a third longitudinal chamber 40 and a fourth longitudinal chamber 50. This first longitudinal chamber 20 is designed to accommodate an electrical wire leading from the motor (rotor unit) or more correctly from the mounting disc (not disclosed) on the motor, which is rotated by the motor and transfers electricity to the blade (10).

A second longitudinal chamber 30 is designed to accommodate, in the first end 12 a transformer/ballast (not illustrated) for regulating the current to the light source. Between the first longitudinal chamber and the second longitudinal chamber is provided a rib/wall 22, which provides strength in the longitudinal direction of the blade 10. Like-wise, the second longitudinal chamber 20 is separated from a third longitudinal chamber 40 by a further wall/rib 32. In the third longitudinal chamber 40 is provided means 42,44 in the shape of a mounting bracket suitable to engage the mounting disc of the motor unit. In this particular embodiment the means 42,44 is in the shape of two sets of flanges which are dimensioned to engage and embrace an engagement member of the mounting disc. Additionally an aperture 46 is provided, such that a fastening screw (not illustrated) may be inserted fastening the engagement member to the blade 10.

A fourth longitudinal chamber 50 is provided adjacent the third longitudinal chamber 40, where the third and fourth longitudinal chambers are separated by a rib/wall 52. The fourth longitudinal chamber 50 is designed to provide the blade with an overall aerodynamic cross-section. In this particular embodiment the curvature of the cross-section facilitates that the in use lower surface 54 will urge air downwards when the blade is brought to rotate in the direction indicated by the arrow 60. The distal or rear edge 56 of the blade 10, is designed relatively sharp, as it will leave the air passing over and below the blade as it travels through the air with as little disturbance as possible—apart from urging air downwards. In this manner less noise is generated.

Overall, the blade is provided with a substantially flush and smooth outer surface.

Figure 4:
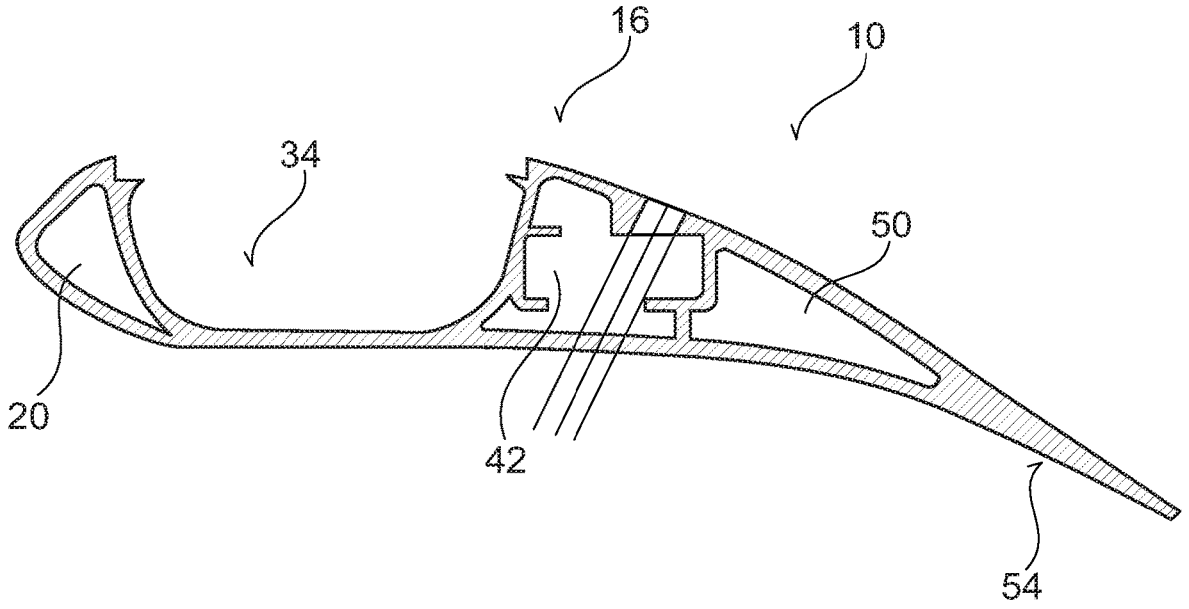
FIG. 4 illustrates a cross-section of the blade 10 near the distal end 16.

In FIG. 4 is illustrated a cross-section of the blade 10 near the distal end 16. The first, third and fourth longitudinal chambers are exactly as described above with reference to the cross-section near the first end (root end)—FIG. 3.

The second longitudinal chamber is modified, by removing part of the surface thereby creating a cavity 34. The cavity is designed to accommodate a light source (not illustrated) either directly or a light source placed in a tray, where the tray is designed to be accommodated in the cavity 34. In this particular embodiment the cavity 34 is open towards what in use will be upwards, but naturally the cavity may also be open downwards.

Figure 5:
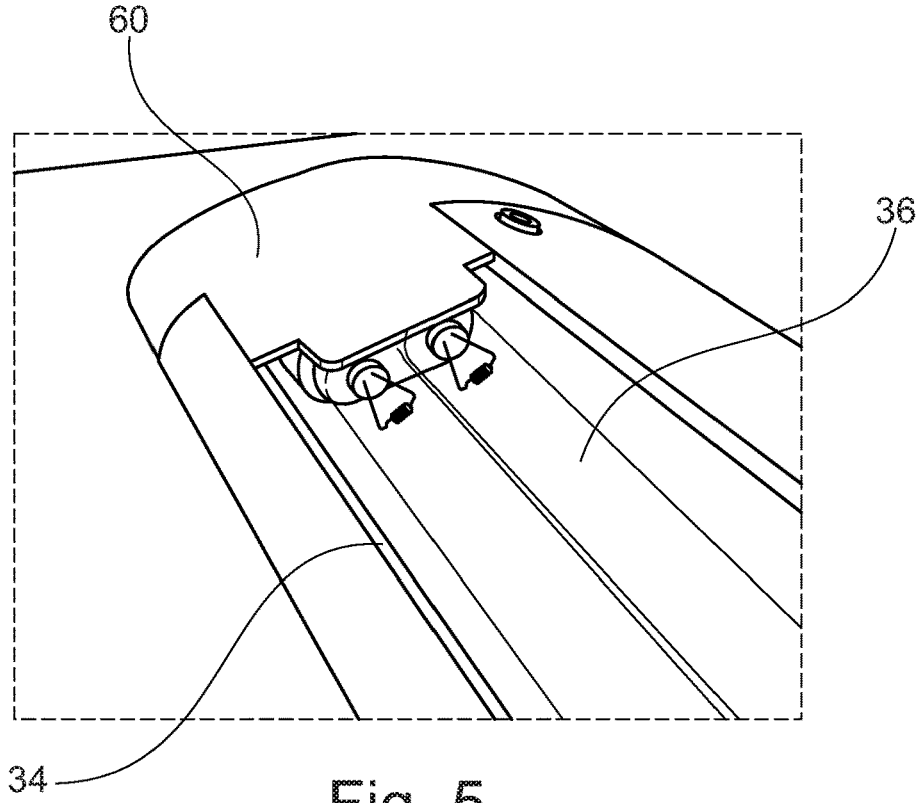
FIGS. 5 and 6 illustrates a distal end 16 of a blade 10 where a light source 36 is arranged in the cavity 34.
Figure 6:
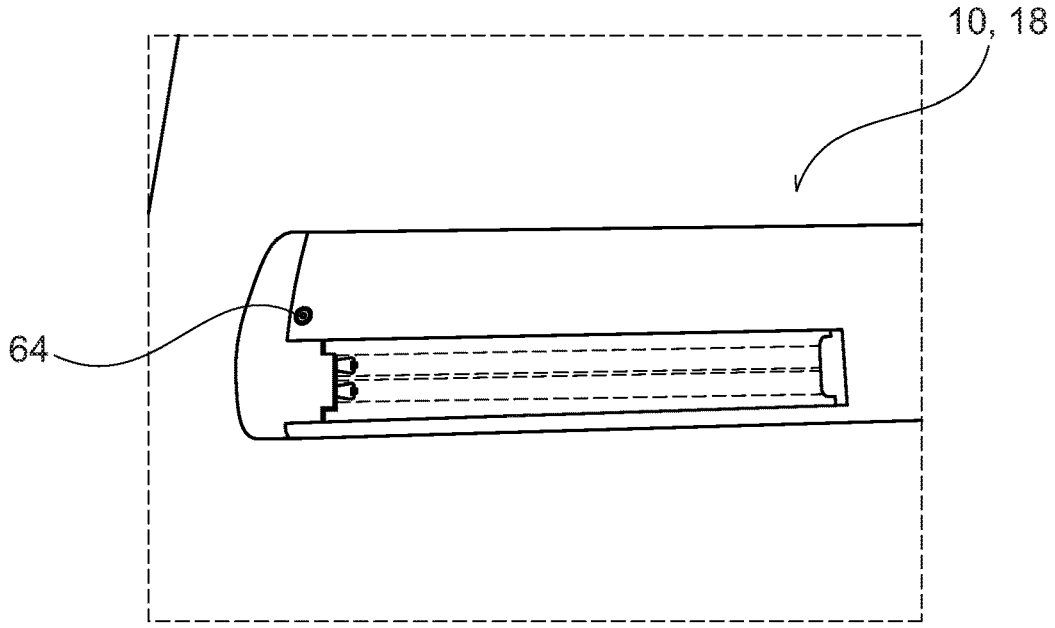
Figure 7:
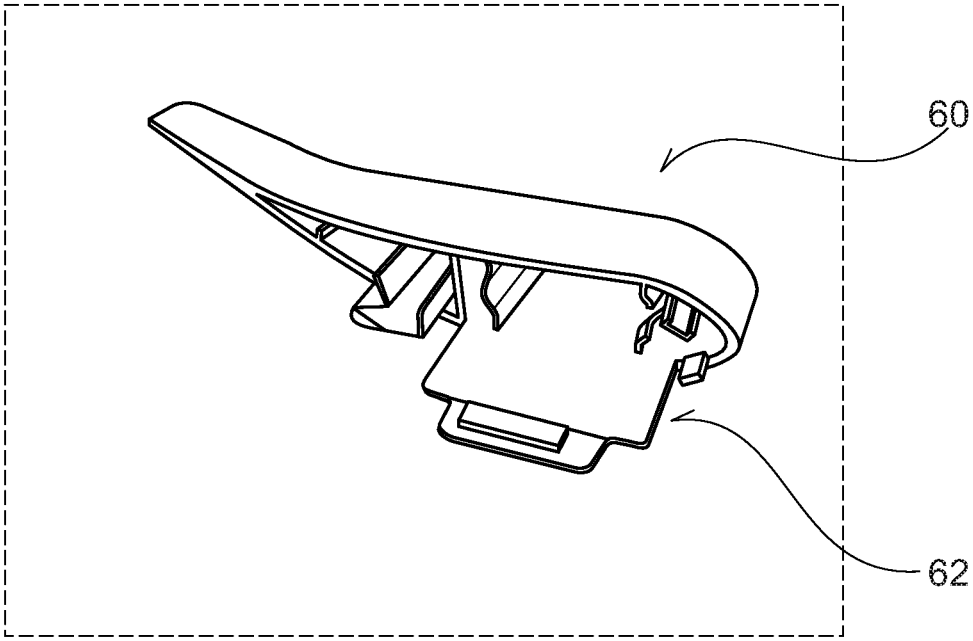
FIG. 7 illustrates an end cap.

In FIGS. 5 and 6 is illustrated a distal end 16 of a blade 10 where a light source 36 is arranged in the cavity 34. Furthermore, an end cap 60 is arranged in the distal end. The end cap 60 has extensions 62 (see FIG. 7) such that when these extensions are inserted into the end of the blade 10, the end cap 60 is held in a position such that the end cap is smooth with the profile of the blade 10, and at the same time retains the light source 36 or the light source tray (not illustrated) in the cavity 18. The end cap may be mechanically fastened as illustrated by the screw 64 in FIG. 6.

The invention claimed is:

1. A blade construction for a blade for a fan, wherein said blade construction incorporates a light source configured to emit light away from said blade, and where said blade has a longitudinal extent in use radially to an axis of rotation for said fan, such that the blade construction has a root end suitable to be attached to a rotor unit, and a distal end furthest away from said root end, where the blade has an aerodynamic profile in a cross-section orthogonal to the longitudinal direction and where said blade construction comprises:

a) a first longitudinal chamber suitable to accommodate an electrical wire;

b) a second longitudinal chamber suitable to accommodate:

i) a transformer unit proximate the root end;

ii) said light source proximate the distal end;

c) a third longitudinal chamber suitable to accommodate:

i) a mounting bracket proximate the root end, the mounting bracket allowing the blade to be mounted to the rotor unit;

ii) an endcap proximate the distal end, the end cap having a cross-section corresponding to the cross-section of the blade, and where the endcap has a closed side and an opposing side having means for being attached to the blade, said means projecting into said third longitudinal chamber; and d) a fourth longitudinal chamber allowing the blade to obtain the aerodynamic profile;

wherein the second longitudinal chamber forms an open top cavity, allowing the light source to emit light out of the cavity, and where either:

light source holding means are provided in the cavity furthest away from said distal end for fixing the light source in the cavity, and where electrical socket connection means are provided proximate the distal end for providing electrical current to the light source, where said electrical socket connection means may be fixable in said end cap, or a light source holding tray is provided, said tray fitting inside the open top cavity, where said tray comprises means for fixing and holding a light source and for providing electrical current to said light source, and wherein the outer dimensions of the tray are configured to be insertable into the open top cavity, and where the means for fixing and holding a light source and for providing electrical current to said light source is different for different trays, such that different size or type of light sources may be installed in different trays.

2. A high-volume low speed fan comprising:

a motor unit; and a plurality of the blade constructions according to claim 1, the plurality of blade constructions being attached to the motor unit.

3. A blade construction comprising:

a main body extending in a longitudinal direction between a root end and a distal end furthest away from the root end, the main body having an aerodynamic profile in cross-section orthogonal to the longitudinal direction, the main body including:

a) a first longitudinal chamber configured to accommodate an electrical wire;

b) a second longitudinal chamber configured to accommodate a transformer unit proximate the root end and to accommodate a light source proximate the distal end, the second longitudinal chamber forming an open top cavity proximate the distal end for allowing the light source to emit light out of the cavity;

c) a third longitudinal chamber configured to accommodate a rotor unit mounting bracket proximate the root end and to accommodate an end cap proximate the distal end; and d) a fourth longitudinal chamber allowing the main body to obtain the aerodynamic profile;

a light source holder for fixing the light source in the open top cavity of the second longitudinal chamber at a location furthest away from the distal end; and an electrical socket for providing electrical current to the light source, the electrical socket being proximate the distal end and fixable in the end cap.

4. The blade construction of claim 3, further including the end cap, the end cap having a cross-section corresponding to a cross-section of the main body, wherein the end cap has a closed side and an opposing side with an extension projecting into the third longitudinal chamber.

5. A high-volume low speed fan comprising:

a motor unit; and a plurality of the blade constructions according to claim 3, the plurality of blade constructions being attached to the motor unit.

6. The blade construction of claim 3, wherein the first, second, third, and fourth chambers are separately formed chambers separated from each other by sidewalls.

7. A blade construction comprising:

a main body extending in a longitudinal direction between a root end and a distal end furthest away from the root end, the main body having an aerodynamic profile in cross-section orthogonal to the longitudinal direction, the main body including:

a) a first longitudinal chamber configured to accommodate an electrical wire;

b) a second longitudinal chamber configured to accommodate a transformer unit proximate the root end and to accommodate a light source proximate the distal end, the second longitudinal chamber forming an open top cavity proximate the distal end for allowing the light source to emit light out of the cavity;

c) a third longitudinal chamber configured to accommodate a rotor unit mounting bracket proximate the root end and to accommodate an end cap proximate the distal end; and d) a fourth longitudinal chamber allowing the main body to obtain the aerodynamic profile; and a light source holding tray disposed within the open top cavity, where the tray is configured to fix and hold a light source and to provide electrical current to said light source, wherein outer dimensions of the tray are configured to be insertable into the open top cavity.

8. The blade construction of claim 7, wherein the tray is one of a plurality of trays insertable within the open top cavity, wherein the plurality of trays have means for fixing and holding a respective light source and for providing electrical current to said light source that are different for different trays, such that different size or type of light sources may be installed in different trays.

9. A high-volume low speed fan comprising:

a motor unit; and a plurality of the blade constructions according to claim 7, the plurality of blade constructions being attached to the motor unit.

10. The blade construction of claim 7, wherein the first, second, third, and fourth chambers are separately formed chambers separated from each other by sidewalls.

* * * * *